US009523047B2

(12) United States Patent
Tertel et al.

(10) Patent No.: US 9,523,047 B2
(45) Date of Patent: Dec. 20, 2016

(54) APPARATUSES AND METHODS FOR TREATING MERCAPTANS

(71) Applicant: UOP LLC, Des Plaines, IL (US)

(72) Inventors: Jonathan Andrew Tertel, Mount Prospect, IL (US); Luigi Laricchia, Arlington Heights, IL (US); Jasna Karagic, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 397 days.

(21) Appl. No.: 14/302,703

(22) Filed: Jun. 12, 2014

(65) Prior Publication Data

US 2015/0361352 A1 Dec. 17, 2015

(51) Int. Cl.

| | |
|---|---|
| ***C10G 53/14*** | (2006.01) |
| ***C10G 53/12*** | (2006.01) |
| ***C10G 19/08*** | (2006.01) |
| ***C10G 21/28*** | (2006.01) |

(52) U.S. Cl.

CPC ..... *C10G 53/14* (2013.01); *C10G 53/12* (2013.01)

(58) Field of Classification Search

CPC ..... C10G 19/00; C10G 19/02; C10G 19/08; C10G 21/00; C10G 21/28; C10G 27/04; C10G 53/12; C10G 53/14

See application file for complete search history.

(56) References Cited

U.S. PATENT DOCUMENTS

| | | | | |
|---|---|---|---|---|
| 2,550,091 | A | 4/1951 | Seebold | |
| 4,412,912 | A | 11/1983 | Asdigian | |
| 4,705,620 | A | 11/1987 | Bricker et al. | |
| 4,753,722 | A | 6/1988 | Le et al. | |
| 7,014,751 | B2 | 3/2006 | Greaney et al. | |
| 7,029,573 | B2 | 4/2006 | Greaney et al. | |
| 7,223,332 | B1 * | 5/2007 | Tertel | C10G 27/06 208/203 |

FOREIGN PATENT DOCUMENTS

| | | | |
|---|---|---|---|
| CN | 100519705 | C | 7/2009 |
| CN | 202465605 | U | 10/2012 |
| CN | 202808743 | U | 3/2013 |
| GB | 663901 | A | 12/1951 |

(Continued)

OTHER PUBLICATIONS

Search Report dated Sep. 17, 2015 for corresponding PCT Appl. No. PCT/US2015/034339.

(Continued)

*Primary Examiner* — Renee E Robinson
*Assistant Examiner* — Derek Mueller

(57) ABSTRACT

Embodiments of apparatuses and methods for treating mercaptans are provided. In one example, an apparatus comprises a vessel capable of receiving a feed stream that comprises liquid hydrocarbons and the mercaptans. The vessel comprises an extraction section that is capable of extracting a portion of the mercaptans from the feed stream to form a mercaptan-reduced, liquid hydrocarbon-containing stream. A catalyst bed section is capable of contacting the mercaptan-reduced, liquid hydrocarbon-containing stream with a catalyst in the presence of oxygen ($O_2$) and caustic at reaction conditions effective to oxidize a remaining portion of the mercaptans and form a sweetened liquid hydrocarbon-containing stream.

20 Claims, 1 Drawing Sheet

(56) References Cited

FOREIGN PATENT DOCUMENTS

| | | | |
|---|---|---|---|
| GB | 788559 | A | 1/1958 |
| IN | 220176 | B | 7/2007 |
| IN | 200100726 | 1 | 7/2008 |
| WO | 02102940 | A1 | 12/2002 |
| WO | 2009035480 | A1 | 3/2009 |
| WO | 2011066523 | A2 | 6/2011 |
| WO | 2013076383 | A1 | 5/2013 |

OTHER PUBLICATIONS

Montagna et al., (Gasoline) Sweetening and Naphtha Pretreating, 164th ACS National Meeting (NY Aug. 27-Sep. 1, 1972) ACS Div Pet Chem Prepr V17 N. 3 B95-B110 (Jul. 1972), Aug. 27, 1972.

Tang et al., Desulfurization of Sour Naturl Gasoline, Petroleum Refinery Engineering (ISSN 1002-106X) V24 N.5 21-23 (Sep. 1994) (in Chinese with English abstract), v24, n5, p. 21-23, Sep. 1994; ISSN: 1002106X.

Suarez, Pluses and Minuses of Cuastic Treating [of HPI Hydrocarbon Streams], Hydrocarbon Processing (ISSN 0018-8190) V75 N.10 117-18, 120, 122-23 (Oct. 1996), v 75, n10, p. 117-18, 120, 122-23, Oct. 1996; ISSN: 00188190.

Pan et al., Removal of Mercaptans from Light Fractions of FCC Naptha by Caustic Extraction, Petroleum Processing and Petrochemicals, v36, n10, p. 24-27, Oct. 2005.

Sharipov, Mercaptan Removal from [motor] Fuels and Liquefied Gases in the Presence of Cobalt Polyphthalocyanine [(Co-PPC)], Khimya i Tekhologiya Topliv i Masel (ISSN 0023-1169) N.1 4-13 (1994), n1, p. 4-13, 1994; ISSN: 00231169.

Pan et al., Study on the Combined Processes for Removing Mercaptans in FCC Naphtha, Petroleum Processing and Petrochemicals, v37, n7, p. 6-10, Jul. 2006; ISSN: 10052399.

Maple et al., Removal of Sulfur from Light FCC Gasoline Stream, NPRA Annual Meeting Papers, v2000, 27p, 2000; Conference: 200 Annual Meeting—National Petrochemical and Refiners Association, Mar. 26, 2000-Mar. 28, 2000.

Ramirez et al., Extraction of Mercaptans from Virgin Light Naphtha from Romashkin Crude Oil by Caustic Washing, Rev. Cenic, Cienc. Fis. 10(1) 1-12 (1979) Chem. Abstr. Abstr. No. 5637 V94 N. 2, 1979.

* cited by examiner

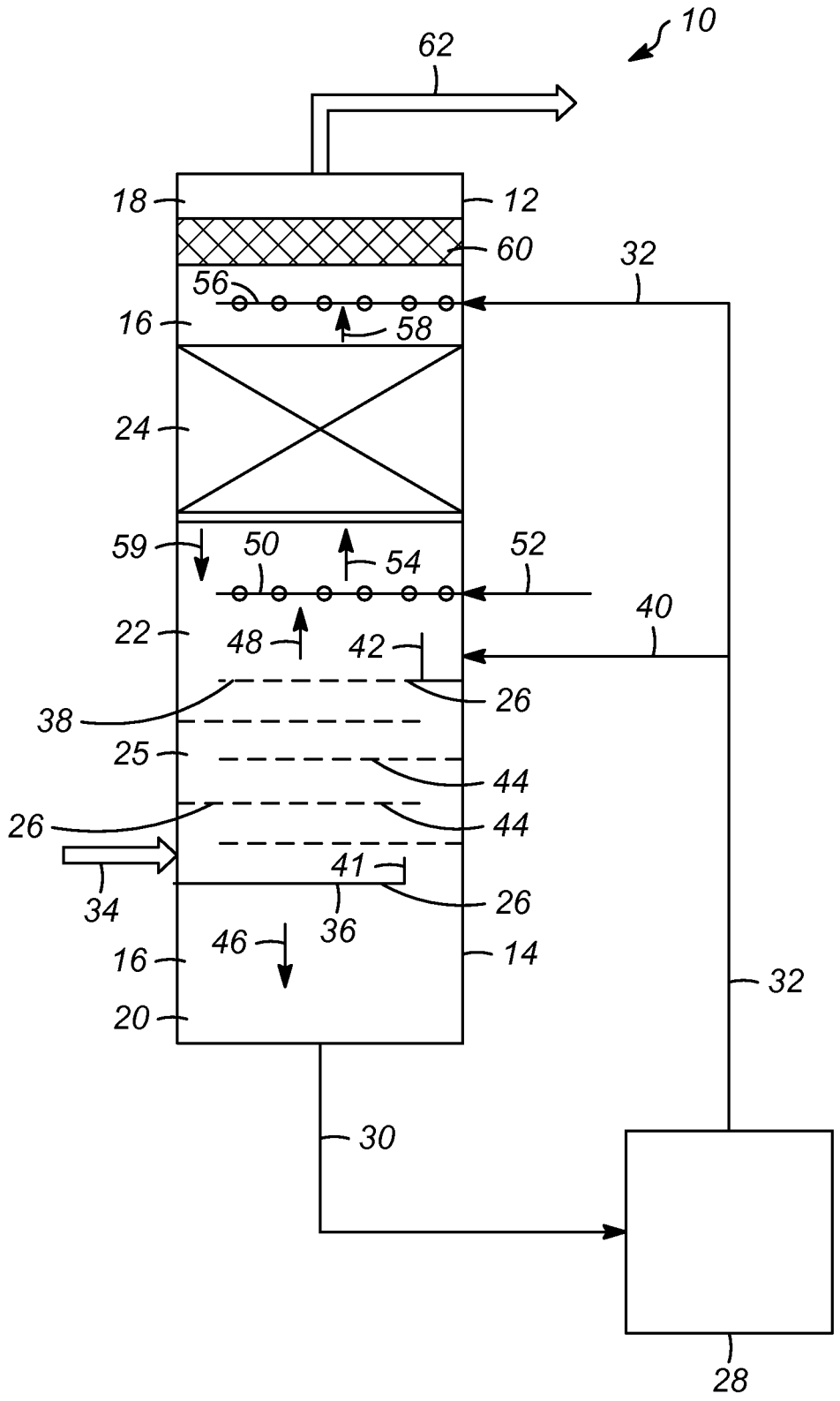
10
62
18
12
60
32
56
16
58
24
59
50
54
52
40
22
48
42
26
38
25
44
26
44
41
34
26
36
46
16
14
32
20
30
28

APPARATUSES AND METHODS FOR TREATING MERCAPTANS

TECHNICAL FIELD

The technical field relates generally to apparatuses and methods for treating mercaptans, and more particularly relates to apparatuses and methods for extracting a portion of the mercaptans contained in a feed stream that includes liquid hydrocarbons such as naphtha boiling range hydrocarbons or the like and oxidizing a remaining portion of the mercaptans in the feed stream to form a sweetened liquid hydrocarbon-containing stream.

BACKGROUND

Sweetening of petroleum fractions, such as naphtha boiling range hydrocarbons or other liquid hydrocarbons, that contain mercaptans (or sour petroleum fractions) are well-developed commercial processes commonly used in many petroleum refineries. In the sweetening process, mercaptans contained in the feed hydrocarbon stream (e.g., sour hydrocarbon stream) are converted to disulfide compounds that remain in the hydrocarbon stream (e.g., sweetened hydrocarbon stream). Sweetening processes, therefore, do not remove sulfur from the hydrocarbon stream but rather convert the sulfur to an acceptable form. The sweetening process involves an admixture of an oxygen-containing stream to the sour hydrocarbon stream to supply the required oxygen. The admixture of hydrocarbons and oxygen contacts an oxidation catalyst in an aqueous alkaline environment to oxidize the mercaptans.

Typically, a caustic (e.g. an aqueous caustic solution containing a caustic material) is combined with the sour hydrocarbon stream to create the aqueous alkaline environment. After contacting the oxidation catalysts, at least a portion of the caustic is carried with the sweetened hydrocarbon stream and can be problematic for further downstream processing. Current approaches for removing caustic from sweetened hydrocarbon streams often require additional downstream equipment items and can be costly and/or are relatively inefficient.

Additionally, the sweetened hydrocarbon stream typically includes a middle boiling range hydrocarbon fraction or fractions (e.g., naphtha boiling range hydrocarbons) that are components of gasoline. Often, it is desirable to lower the overall sulfur content including the amount of disulfide compounds in gasoline and/or other like hydrocarbon products. Current approaches for reducing the amount of disulfide compounds in sweetened hydrocarbon streams prior to incorporation into gasoline or other like hydrocarbon products often require additional equipment items and can be costly and/or are relatively inefficient.

Accordingly, it is desirable to provide apparatuses and methods for the oxidation of mercaptans contained in a feed stream that includes liquid hydrocarbons such as naphtha boiling range hydrocarbons or the like for forming a sweetened hydrocarbon stream with enhanced removal of caustic from the sweetened hydrocarbon stream. Additionally, it is desirable to provide apparatuses and methods for the oxidation of mercaptans contained in a feed stream that includes liquid hydrocarbons such as naphtha boiling range hydrocarbons or the like for forming a sweetened hydrocarbon stream with lower overall sulfur content. Furthermore, other desirable features and characteristics of the present invention will become apparent from the subsequent detailed description and the appended claims, taken in conjunction with the accompanying drawings and this background.

BRIEF SUMMARY

Apparatuses and methods for treating mercaptans are provided herein. In accordance with an exemplary embodiment, an apparatus for treating mercaptans comprises a vessel capable of receiving a feed stream that comprises liquid hydrocarbons and the mercaptans. The vessel comprises an extraction section that is capable of extracting a portion of the mercaptans from the feed stream to form a mercaptan-reduced, liquid hydrocarbon-containing stream. A catalyst bed section is capable of contacting the mercaptan-reduced, liquid hydrocarbon-containing stream with a catalyst in the presence of oxygen ($O_2$) and caustic at reaction conditions effective to oxidize a remaining portion of the mercaptans and form a sweetened liquid hydrocarbon-containing stream.

In accordance with another exemplary embodiment, an apparatus for treating mercaptans is provided. The apparatus comprises a vessel that is capable of receiving an $O_2$-containing stream, a first lean caustic stream, and a feed stream that comprises liquid hydrocarbons and the mercaptans. The vessel comprises a vessel wall that extends generally vertically and that encloses an internal volume. An extraction section is disposed in the internal volume and is capable of extracting a first portion of the mercaptans from the feed stream to form a mercaptan-reduced, liquid hydrocarbon-containing stream. A catalyst bed section is disposed in the internal volume in fluid communication with the extraction section. The catalyst bed section is capable of contacting the mercaptan-reduced, liquid hydrocarbon-containing stream with a catalyst in the presence of the $O_2$-containing stream and the first lean caustic stream at reaction conditions effective to oxidize a remaining portion of the mercaptans and form a sweetened liquid hydrocarbon-containing stream.

In accordance with another exemplary embodiment, a method for treating mercaptans is provided. The method comprises the steps of introducing a feed stream that comprises liquid hydrocarbons and the mercaptans to a vessel. The feed stream is contacted with a lean caustic stream in the vessel to extract a portion of the mercaptans from the feed stream and form a mercaptan-reduced, liquid hydrocarbon-containing stream. The mercaptan-reduced, liquid hydrocarbon-containing stream is contacted with a catalyst in the vessel in the presence of oxygen ($O_2$) and caustic at reaction conditions effective to oxidize a remaining portion of the mercaptans and form a sweetened liquid hydrocarbon-containing stream.

BRIEF DESCRIPTION OF THE DRAWINGS

The various embodiments will hereinafter be described in conjunction with the following drawing figures, wherein like numerals denote like elements, and wherein:

FIG. 1 schematically illustrates an apparatus and method for treating mercaptans in accordance with an exemplary embodiment.

DETAILED DESCRIPTION

The following Detailed Description is merely exemplary in nature and is not intended to limit the various embodiments or the application and uses thereof. Furthermore, there is no intention to be bound by any theory presented in the preceding background or the following detailed description.

Various embodiments contemplated herein relate to apparatuses and methods for treating mercaptans. The exemplary embodiments taught herein introduce a feed stream that comprises that comprises liquid hydrocarbons, such as naphtha boiling range hydrocarbons, kerosene boiling range hydrocarbons, diesel boiling range hydrocarbons, and/or the like, for example naphtha boiling range hydrocarbons, and mercaptans to a vessel. As used herein, the term "naphtha" refers to a middle boiling range hydrocarbon fraction or fractions that are components of gasoline. In an exemplary embodiment, naphtha includes hydrocarbons (e.g., $C_5$-$C_{12}$ hydrocarbons and various olefins, aromatics, and di-olefins) having boiling points at atmospheric pressure of from about 10 to about 220° C. As used herein, $C_x$ means hydrocarbon molecules that have "X" number of carbon atoms, $C_x^+$ means hydrocarbon molecules that have "X" and/or more than "X" number of carbon atoms, and $C_x^-$ means hydrocarbon molecules that have "X" and/or less than "X" number of carbon atoms.

The vessel comprises an extraction section that extracts a portion of the mercaptans from the feed stream to form a mercaptan-reduced, liquid hydrocarbon-containing stream that has a reduced or lower mercaptan content relative to the feed stream. Also contained in the vessel is a catalyst bed section that is in fluid communication with the extraction section. The mercaptan-reduced, liquid hydrocarbon-containing stream is passed through the catalyst bed and contacts a catalyst in the presence of oxygen ($O_2$) and caustic (e.g., an aqueous caustic solution that includes caustic material) at reaction conditions effective to oxidize a remaining portion of the mercaptans and form a sweetened liquid hydrocarbon-containing stream. Because the mercaptans-reduced, liquid hydrocarbon-containing stream has a relatively lower mercaptan content, less disulfide compounds are formed and present in the sweetened liquid hydrocarbon-containing stream as compared to other sweetened liquid hydrocarbon-containing streams that are formed by conventional sweetening processes.

In an exemplary embodiment, the vessel further comprises a coalescing mesh. Prior to removing the sweetened liquid hydrocarbon-containing stream from the vessel, the sweetened stream is passed through the coalescing mesh to coalesce and efficiently separate the caustic from the sweetened liquid hydrocarbon-containing stream. In an exemplary embodiment, the sweetened liquid hydrocarbon-containing stream is substantially depleted from caustic and is then removed from the vessel, for example, for further downstream processing without requiring additional equipment items and/or cost for removing caustic.

FIG. 1 schematically illustrates an apparatus 10 for treating mercaptans in accordance with an exemplary embodiment. As illustrated, the apparatus 10 comprises a vessel 12 including a vessel wall 14 that extends generally vertically and encloses an internal volume 16. The internal volume 16 has an upper portion 18, a lower portion 20, and an intermediate portion 22 that is disposed between the upper and lower portions 18 and 20.

As illustrated, in an exemplary embodiment, the vessel 12 has a catalyst bed section 24 and an extraction section 25 that are in fluid communication with each other. The catalyst bed section 24 is disposed in the intermediate portion 22 adjacent to the upper portion 18 of the internal volume 16. The catalyst bed section 24 contains a catalyst, e.g., a mercaptan oxidation catalyst, with an active catalyst component(s). The catalyst may include the active catalyst component(s) impregnated on a solid material (e.g., particulates) that is retained in the catalyst bed section 24. Any commercially suitable mercaptan oxidation catalyst can be employed as the active catalyst component(s). For instance, a catalyst comprising a metal compound of tetrapyridinoporphyrazine that is retained on an inert granular support may be used. Alternatively, the mercaptan oxidation catalyst may include a metallic phthalocyanine. The metal(s) of the metallic phthalocyanine may be titanium, zinc, iron, manganese, cobalt, and/or vanadium. The metal phthalocyanine may be employed as a derivative compound. Commercially available sulfonated compounds such as cobalt phthalocyanine monosulfonate, cobalt phthalocyanine disulfonate, and/or other mono-, di-, tri-, and tetra-sulfo derivatives may also be employed as the mercaptan oxidation catalyst. Other derivatives including carboxylated derivatives, as prepared by the action of trichloroacetic acid on the metal phthalocyanine, can also be used as the mercaptan oxidation catalyst.

In an exemplary embodiment, the solid material on which the active catalyst component(s) is supported in the catalyst is an inert absorbent carrier material. The carrier material may be in the form of tablets, extrudates, spheres, or randomly shaped naturally occurring pieces. Natural materials such as clays and silicates or refractory inorganic oxides may be used as the support material. The support may be formed from diatomaceous earth, kieselguhr, kaolin, alumina, zirconia, or the like. In an exemplary embodiment, the catalyst comprises a carbon-containing support, such as, for example, charcoal that has been thermally and/or chemically treated to yield a highly porous structure similar to activated carbon. The active catalyst component(s) may be added to the support in any suitable manner, as by impregnation by dipping, followed by drying. The catalyst may also be formed in-situ within the catalyst bed section 24. In an exemplary embodiment, the catalyst contains from about 0.1 to about 10 weight percent (wt. %) of a metal phthalocyanine. The solid or supported catalyst may comprise only the contact material that fills the catalyst bed section 24 or may be admixed with other solids. In an exemplary embodiment, Merox No. 8™, Merox No. 10™, Merox No. 21™, or Merox No. 31™, which are commercially available from UOP LLC and comprise the active catalyst component(s) impregnated on a carbon support, is used as the catalyst.

As illustrated, the extraction section 25 is disposed in the intermediate portion 22 between the lower portion 20 of the internal volume 16 and the catalyst bed section 24. Although the catalyst bed section 24 and the extraction section 25 are shown as both being disposed in the intermediate portion 22, other arrangements of the catalyst bed section 24 and the extraction section 25 in the vessel 12 may be used. As will be discussed in further detail below, the extraction section 25 is capable of providing countercurrent contact between two separate liquid phase streams to extract mercaptans from one of the liquid phase streams to the other of the liquid phase streams. In an exemplary embodiment, the extraction section 25 comprises a plurality of horizontal trays 26 that are spaced apart and optionally vertically aligned. In an exemplary embodiment, a total number of the horizontal trays 26 in the extraction section 25 is from 3 to 12 trays.

In fluid communication with the vessel 12 is a caustic regeneration zone 28. As used herein, the term "zone" refers to an area including one or more equipment items and/or one or more sub-zones. Equipment items can include one or more reactors or reactor vessels, scrubbers, strippers, fractionators or distillation columns, absorbers or absorber vessels, regenerators, heaters, exchangers, coolers/chillers, pipes, pumps, compressors, controllers, and the like. Additionally, an equipment item can further include one or more zones or sub-zones. As will be discussed in further detail below, the caustic regeneration zone 28 is capable of receiving and regenerating a rich caustic stream 30 from the vessel 12 to form a lean caustic stream 32.

During operation of the apparatus 10, a feed stream 34 comprising liquid hydrocarbons, such as naphtha boiling range hydrocarbons and/or the like, for example naphtha boiling range hydrocarbons, and mercaptans is introduced to the vessel 12. In an exemplary embodiment, the feed stream 34 is substantially free of $H_2S$ and is introduced into the internal volume 16 just above a lowermost horizontal tray 36 with a weir 41. Just above an uppermost horizontal tray 38, a lean caustic stream 40, which is a side stream from the lean caustic stream 32, is introduced into the internal volume 16 of the vessel 12 just behind a weir 42. The lean caustic stream 40 flows over the weir 42 and across the uppermost horizontal tray 38. In an exemplary embodiment and as illustrated, the lowermost horizontal tray 36 is configured as a blind horizontal tray and the remaining horizontal trays 26 are configured as perforated horizontal trays.

In an exemplary embodiment, the lean caustic streams 32 and 40 are an aqueous caustic solution comprising a caustic material, such as, for example, sodium hydroxide (NaOH) that is present in an amount of from about 5 to about 15 wt. % of the aqueous caustic solution and has a density of from about 1 to about 1.2 g/cc. In an exemplary embodiment, the feed stream 34 has a density of from about 0.6 to about 0.8 g/cc. As such, the density difference between the lean caustic stream 40 and the feed stream 34 naturally forces the lean caustic stream 40 to descend from the uppermost horizontal tray 38 to the horizontal trays 26 below while the feed stream 34 rises from the lowermost horizontal tray 36 to the horizontal trays 26 above, passing through openings 44 in the horizontal trays 26 to provide liquid-liquid countercurrent contact between the streams 34 and 40. During contact, a portion of the mercaptans are extracted from the feed stream 34 into the lean caustic stream 40 to form rich caustic (indicated by single headed arrow 46) and a mercaptan-reduced, liquid hydrocarbon-containing stream (indicated by single headed arrow 48). In an exemplary embodiment, lighter end mercaptans ($C_3^-$ mercaptans) are substantially extracted from the feed stream 34 while the heavier end mercaptans ($C_4^+$ mercaptans) are not substantially extracted or are extracted to a much lesser extent than the lighter end mercaptans. In an exemplary embodiment, $C_3^-$ mercaptans are greater than 95 wt. % extractable and the $C_4^+$ mercaptans are less than 80 weight percent extractable. In an exemplary embodiment, the mercaptan-reduced, liquid hydrocarbon-containing stream 48 comprises naphtha boiling range hydrocarbons and heavier end mercaptans and is substantially depleted of lighter end mercaptans. In an exemplary embodiment, the rich caustic 46 is an aqueous caustic solution that contains mercaptan impurities including sulfides and organic acids.

In an embodiment and as illustrated in FIG. 1, a distributor 50 is disposed in the intermediate portion 22 of the internal volume 16 between the catalyst bed and extraction sections 24 and 25. An $O_2$-containing stream 52 is passed through the distributor 50 and combined with the mercaptan-reduced, liquid hydrocarbon-containing stream 48 to form a combined stream (indicated by single headed arrow 54). In an exemplary embodiment, the $O_2$-containing stream 52 is air and the combined stream 54 comprises $O_2$ present in an amount of about 150% to about 200% of the stoichiometric amount required for oxidation of the mercaptans contained in the mercaptan-reduced, liquid hydrocarbon-containing stream 48 to form disulfide compounds.

In an exemplary embodiment, the vessel 12 operates as a liquid-full vessel. As used herein, the term "liquid-full vessel" means that during operation, the vessel 12 is completely full of liquid and any gases, e.g., oxygen, air, and/or the like, that are present are dissolved in a liquid phase without forming any pockets of gas or gaseous phase pockets (e.g., air pockets). As such, the combined stream 54 is completely in the liquid phase.

Disposed above the catalyst bed section 24 is a distributor 56. The lean caustic stream 32 is passed through the distributor 56 and is distributed into the internal volume 16 in or near the upper portion 18 of the vessel 12. As discussed above, the lean caustic stream 32 is an aqueous caustic solution having a density greater than the density of the naphtha boiling range hydrocarbons. As such, the lean caustic stream 32 descends in the internal volume 16 into the catalyst bed section 24 while the combined stream 54 rises into the catalyst bed section 24.

In the catalyst bed section 24, the combined stream 54 contacts the catalyst that is contained therein. In an exemplary embodiment, the catalyst bed section 24 is operated at reaction conditions effective to oxidize the remaining portion of the mercaptans (e.g., heavy end mercaptans) in the presence of $O_2$ and caustic to form disulfide compounds, thereby sweetening the combined stream 54 forming a sweetened liquid hydrocarbon-containing stream (indicated by single headed arrow 58). In an exemplary embodiment, the sweetened liquid hydrocarbon-containing stream 58 comprises the naphtha boiling range hydrocarbons, the disulfide compounds, and a portion of the caustic (e.g., aqueous caustic solution). In an exemplary embodiment, the sweetened liquid hydrocarbon-containing stream 58 comprises the mercaptans present in an amount of about 1 ppm or less, such as from about 0.1 to about 1 ppm based on weight of the sweetened liquid hydrocarbon-containing stream 58. In an exemplary embodiment, the reaction conditions include temperature of from about 20 to about 65° C., a residence time of from about 15 minutes to about 1 hour, and a pressure of from about 345 to about 1500 kPa. As illustrated, a remaining portion of caustic (indicated by single headed arrow 59) descends from the catalyst bed section 24 towards the extraction section 25.

In an exemplary embodiment, the vessel 12 further comprises a coalescing mesh 60 that is disposed in the upper portion 18 of the internal volume 16 above the distributor 56. The coalescing mesh 60 is capable of coalescing and separating at least a portion of the caustic in the sweetened liquid hydrocarbon-containing stream 58 to form a sweetened liquid hydrocarbon-containing stream 62. In an aspect, the coalescing mesh 60 may be made of a hydrophilic material or be coated with a hydrophilic material. In an exemplary embodiment, the sweetened liquid hydrocarbon-containing stream 62 is substantially depleted of caustic having less than 1 ppm by weight of NaOH. In an exemplary embodiment, the coalescing mesh 60 serves to gather together droplets of caustic (e.g., dissolved in an aqueous phase) that rises with the sweetened liquid hydrocarbon-containing stream 58 to give them sufficient weight to begin descending towards the lower portion 20 of the internal volume to collect with the rest of the rich caustic 46. Various commercially available coalescing meshes may be used as the coalescing mesh 60. For example, various Coalex™ meshes from Koch-Glitsch, located in Wichita, Kans., may be used.

As illustrated, the sweetened liquid hydrocarbon-containing stream 62 is removed from the upper portion 18 of the vessel 12 as, for example, a product stream. The rich caustic 46 is removed from the lower portion 20 of the vessel 12 as the rich caustic stream 30.

In an exemplary embodiment, the rich caustic stream 30 is introduced to the caustic regeneration zone 28 to regenerate the rich caustic and form the lean caustic stream 32. Various caustic regeneration zone arrangements known to those skilled in the art may be used to regenerate the rich caustic. For example, the caustic regeneration zone 28 may include various equipment items such as a gravity or solvent wash separator(s), a fractionation column(s), an oxidizer(s), and/or the like to remove the mercaptan impurities including sulfides and organic acids from the rich caustic to form the lean caustic stream 32.

Accordingly, apparatuses and methods for treating mercaptans have been described. The exemplary embodiments taught herein introduce a feed stream that comprises liquid hydrocarbons, such as naphtha boiling range hydrocarbons and/or the like, and mercaptans to a vessel. The feed stream is contacted with a lean caustic stream in the vessel to extract a portion of the mercaptans from the feed stream and form a mercaptan-reduced, liquid hydrocarbon-containing stream. The mercaptan-reduced, liquid hydrocarbon-containing stream is contacted with a catalyst in the vessel in the presence of oxygen ($O_2$) and caustic at reaction conditions effective to oxidize a remaining portion of the mercaptans and form a sweetened liquid hydrocarbon-containing stream.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. An apparatus for treating mercaptans comprising:

a vessel capable of receiving a feed stream that comprises liquid hydrocarbons and the mercaptans, wherein the vessel comprises:

an extraction section capable of extracting a portion of the mercaptans from the feed stream to form a mercaptan-reduced, liquid hydrocarbon-containing stream, said extraction section including a feed stream inlet; and a catalyst bed section capable of contacting the mercaptan-reduced, liquid hydrocarbon-containing stream with a catalyst in the presence of oxygen ($O_2$) and caustic at reaction conditions effective to oxidize a remaining portion of the mercaptans and form a sweetened liquid hydrocarbon-containing stream.

2. The apparatus of claim 1, wherein the extraction section is capable of receiving a lean caustic stream and of liquid-liquid countercurrent contacting between the feed stream and the lean caustic stream to extract the portion of the mercaptans.

3. The apparatus of claim 2, wherein the extraction section comprises a plurality of horizontal trays that are spaced apart and vertically aligned, and wherein the horizontal trays are capable of providing liquid-liquid countercurrent contact between the feed stream and the lean caustic stream.

4. The apparatus of claim 3, wherein a total number of the horizontal trays in the extraction section is from 3 to 12 trays.

5. The apparatus of claim 2, wherein the vessel is capable of forming a rich caustic stream from used caustic from the extraction section and/or the catalyst bed section, and wherein the apparatus further comprises:

a caustic regeneration zone that is capable of receiving and regenerating the rich caustic stream to form the lean caustic stream.

6. The apparatus of claim 5, wherein the caustic regeneration zone is capable of forming the lean caustic stream that is an aqueous solution comprising NaOH present in an amount of from about 5 to about 15 wt. % of the aqueous solution.

7. The apparatus of claim 1, wherein the vessel further comprises a coalescing mesh in fluid communication with the catalyst bed section, and wherein the coalescing mesh is capable of coalescing and separating the caustic from the sweetened liquid hydrocarbon-containing stream prior to the sweetened liquid hydrocarbon-containing stream being removed from the vessel.

8. An apparatus for treating mercaptans comprising:

a vessel capable of receiving an $O_2$-containing stream, a first lean caustic stream, and a feed stream that comprises liquid hydrocarbons and the mercaptans, the vessel comprising:

a vessel wall that extends generally vertically and that encloses an internal volume;

an extraction section disposed in the internal volume and capable of extracting a first portion of the mercaptans from the feed stream to form a mercaptan-reduced, liquid hydrocarbon-containing stream; and a catalyst bed section disposed in the internal volume in fluid communication with the extraction section, wherein the catalyst bed section is capable of contacting the mercaptan-reduced, liquid hydrocarbon-containing stream with a catalyst in the presence of the $O_2$-containing stream and the first lean caustic stream at reaction conditions effective to oxidize a remaining portion of the mercaptans and form a sweetened liquid hydrocarbon-containing stream.

9. The apparatus of claim 8, wherein the vessel is capable of operating as a liquid-full vessel.

10. The apparatus of claim 8, wherein the vessel further comprises a first distributor that is disposed in the internal volume and that is in fluid communication with the catalyst bed section, and wherein the first distributor is capable of distributing the first lean caustic stream in the internal volume for introduction to the catalyst bed section.

11. The apparatus of claim 8, wherein the vessel further comprises a second distributor that is disposed in the internal volume and that is in fluid communication with the catalyst bed section to introduce the $O_2$-containing stream to the catalyst bed section.

12. The apparatus of claim 11, wherein the second distributor is disposed between the extraction section and the catalyst bed section to combine the $O_2$-containing stream with the mercaptan-reduced, liquid hydrocarbon-containing stream for introduction to the catalyst bed section.

13. The apparatus of claim 8, wherein the vessel is capable of receiving a second lean caustic stream, and wherein the extraction section comprises a plurality of horizontal trays that are spaced apart and vertically aligned to provide liquid-liquid countercurrent contact between the feed stream and the second lean caustic stream.

14. The apparatus of claim 13, wherein the plurality of horizontal trays has an uppermost horizontal tray, and wherein the extraction section is capable of receiving the second lean caustic stream proximate the uppermost horizontal tray.

15. The apparatus of claim 14, wherein the plurality of horizontal trays has a lowermost horizontal tray, and wherein the extraction section is capable of receiving the feed stream proximate the lowermost horizontal tray.

16. A method for treating mercaptans, the method comprising the steps of:

introducing a feed stream that comprises liquid hydrocarbons and the mercaptans to a vessel;

contacting the feed stream with a lean caustic stream in the vessel to extract a portion of the mercaptans from the feed stream and form a mercaptan-reduced, liquid hydrocarbon-containing stream; and contacting the mercaptan-reduced, liquid hydrocarbon-containing stream with a catalyst in the vessel in the presence of oxygen ($O_2$) and caustic at reaction conditions effective to oxidize a remaining portion of the mercaptans and form a sweetened liquid hydrocarbon-containing stream.

17. The method of claim 16, wherein the step of contacting the mercaptan-reduced, liquid hydrocarbon-containing stream comprises contacting the mercaptan-reduced, liquid hydrocarbon-containing stream with the catalyst at the reaction conditions that include a temperature of from about 20 to about 65° C.

18. The method of claim 16, wherein the step of contacting the mercaptan-reduced, liquid hydrocarbon-containing stream comprises contacting the mercaptan-reduced, liquid hydrocarbon-containing stream with the catalyst at the reaction conditions that include a residence time of from about 15 minutes to about 1 hour.

19. The method of claim 16, wherein the step of contacting the mercaptan-reduced, liquid hydrocarbon-containing stream comprises contacting the mercaptan-reduced, liquid hydrocarbon-containing stream with the catalyst at the reaction conditions that include a pressure of from about 345 to about 1500 kPa.

20. The method of claim 16, wherein the step of introducing the feed stream comprises introducing the feed stream that is substantially free of $H_2S$ to the vessel.

* * * * *